US005338441A

United States Patent [19]

LeViness et al.

[11] Patent Number: 5,338,441

[45] Date of Patent: Aug. 16, 1994

[54] LIQUEFACTION PROCESS

[75] Inventors: Steve C. LeViness; Steve J. Hsia; Michael Y. Wen; Stephen M. Davis; Claude C. Culross; Peter S. Maa, all of Baton Rouge, La.

[73] Assignee: Exxon Research and Engineering Company, Florham Park, N.J.

[21] Appl. No.: 960,335

[22] Filed: Oct. 13, 1992

[51] Int. Cl.[5] ..... C10G 1/06; C10G 1/08

[52] U.S. Cl. ..... 208/419; 208/420; 208/421; 208/422; 208/423

[58] Field of Search ..... 208/419, 420, 421, 422, 208/423

[56] References Cited

U.S. PATENT DOCUMENTS

| | | | |
|---|---|---|---|
| 3,532,617 | 10/1970 | Hodgson | 208/421 |
| 3,645,885 | 2/1972 | Harris et al. | 208/416 |
| 3,813,329 | 5/1974 | Gatsis | 208/419 |
| 3,920,536 | 11/1975 | Seitzer et al. | 208/421 |
| 4,077,867 | 3/1978 | Aldridge et al. | 208/420 |
| 4,196,072 | 4/1980 | Aldridge et al. | 208/421 |
| 4,251,346 | 2/1981 | Dry et al. | 208/422 |
| 4,485,008 | 11/1984 | Maa et al. | 208/420 |
| 4,561,964 | 12/1985 | Singhal et al. | 208/420 |
| 5,064,527 | 11/1991 | Singhal et al. | 208/420 |

*Primary Examiner*—R. Bruce Breneman
*Assistant Examiner*—P. L. Hailey
*Attorney, Agent, or Firm*—Richard D. Jordan

[57] ABSTRACT

The present invention relates to a catalytic process for converting a solid carbonaceous material, such as coal, to a liquid product in the presence of hydrogen. More particularly, this invention relates to a coal liquefaction process wherein a mixture of coal, bottoms, solvent and a sulfiding agent is subjected to liquefaction conditions in the presence of a catalyst precursor. This catalyst or catalyst precursor is comprised of a thermally decomposable compound of Groups IIB, IVB, VB, VIB, VIIB, and VIII of the Periodic Table of the Elements such as molybdenum.

12 Claims, 2 Drawing Sheets

LIQUEFACTION PROCESS DEMONSTRATING SULFUR ADDITION

VGO - VACUUM GAS OIL

LIQUEFACTION PROCESS DEMONSTRATING SULFUR ADDITION

VGO - VACUUM GAS OIL

LIQUEFACTION PROCESS

FIELD OF THE INVENTION

This invention relates to a catalytic process for converting a solid carbonaceous material, such as coal, to a liquid product.

BACKGROUND OF THE INVENTION

Hydroconversion of coal to coal liquids in a hydrogen donor solvent process (liquefaction employing hydrogen) is well known. In such a process, a slurry of coal in a hydrogen donor solvent is reacted in the presence of molecular hydrogen at elevated temperature and pressure. See, for example, U.S. Pat. No. 3,645,885, the teachings of which are hereby incorporated by reference. The hydrogen donor solvent which becomes hydrogen depleted during the coal liquefaction reaction, in the prior art processes, is generally subjected to an independent hydrogenation step prior to its being recycled to the Hydroconversion Zone.

It is also known to convert coal to liquid products by hydrogenation of coal which has been impregnated with an oil-soluble metal naphthenate or by hydrogenation of coal in a liquid medium such as an oil having a boiling range of 250° C. (482° F.) to 325° C. (617° F.) containing an oil-soluble metal naphthenate, as shown in Bureau of Mines Bulletin No. 622, published 1965, entitled "Hydrogenation of Coal in Batch Autoclave", pages 24 to 28. Concentrations as low as 0.01% metal naphthenate catalysts, calculated as the metal, were found to be effective for the conversion of coal. U.S. Pat. Nos. 3,532,617 and 3,502,564 also disclose the use of metal naphthenates in coal hydroconversion.

U.S. Pat. No. 3,920,536 discloses a process for the liquefaction of sub-bituminous coal in a hydrogen donor solvent in the presence of molecular hydrogen, carbon monoxide, water, and an alkali metal or ammonium heptamolybdate in an amount ranging from 0.5 to 10 percent by weight of the coal. U.S. Pat. No. 4,485,008 discloses a process for hydroconverting coal in a hydrogen donor solvent to liquid hydrocarbon products in the presence of a catalyst prepared in situ from a small amount of metals added to the mixture of coal and solvent as oil soluble metal compounds. Recycled solids concentrate may also be present in this invention., although it is not critical.

In prior art liquefaction processes, those processes in which coal is liquefied in the absence of added catalyst and in the presence of a solvent or diluent have been favored over catalytic processes even though the non-catalytic processes do not result in complete conversion of available carbon to either a liquid or gaseous product. One reason for this preference is the relatively high cost of the catalyst and the cost associated with its recovery and return to the liquefaction zone. In either case, the catalytic processes of the prior art have not, on a continuous basis, approached quantitative conversion of the available carbon and have not been economically attractive when compared to the thermal conversion processes. Since quantitative conversion of available carbon is most desirable, however, the need for an improved catalytic process is readily apparent.

It is well known in the liquefaction art that molybdenum sulfide catalyst must be present in a highly dispersed form in order to function effectively as a catalyst. The preferred process conditions needed to provide a catalytic material with optimum activity have not been clearly defined, at least for process applications using low cost catalyst precursors such as phosphomolybdic acid. With high sulfur coals such as Illinois, it has been found that effective catalysts can be formed in situ during liquefaction by simply adding phosphomolybdic acid to fresh coal/solvent/bottoms slurry mixtures. Similar behavior has been noted during catalytic conversion of residuum.

SUMMARY OF THE INVENTION

A process for the liquefaction of a solid carbonaceous material, which process comprises:

a. forming a mixture of solid carbonaceous material, a catalyst or a catalyst precursor and an effective amount of a solvent, and said catalyst or catalyst precursor being comprised of a thermally decomposable compound of Groups IIB, IVB, VB, VIB, VIIB and VIII of the Periodic Table of the Elements;

b. introducing an effective amount of sulfiding agent into said mixture that results in a presulfided solid carbonaceous material and catalyst; and c. introducing said mixture into a Liquefaction Zone, wherein at least a portion of said solid carbonaceous material is converted in the presence of hydrogen to a liquid product.

DETAILED DESCRIPTION OF INVENTION

Figure 1:
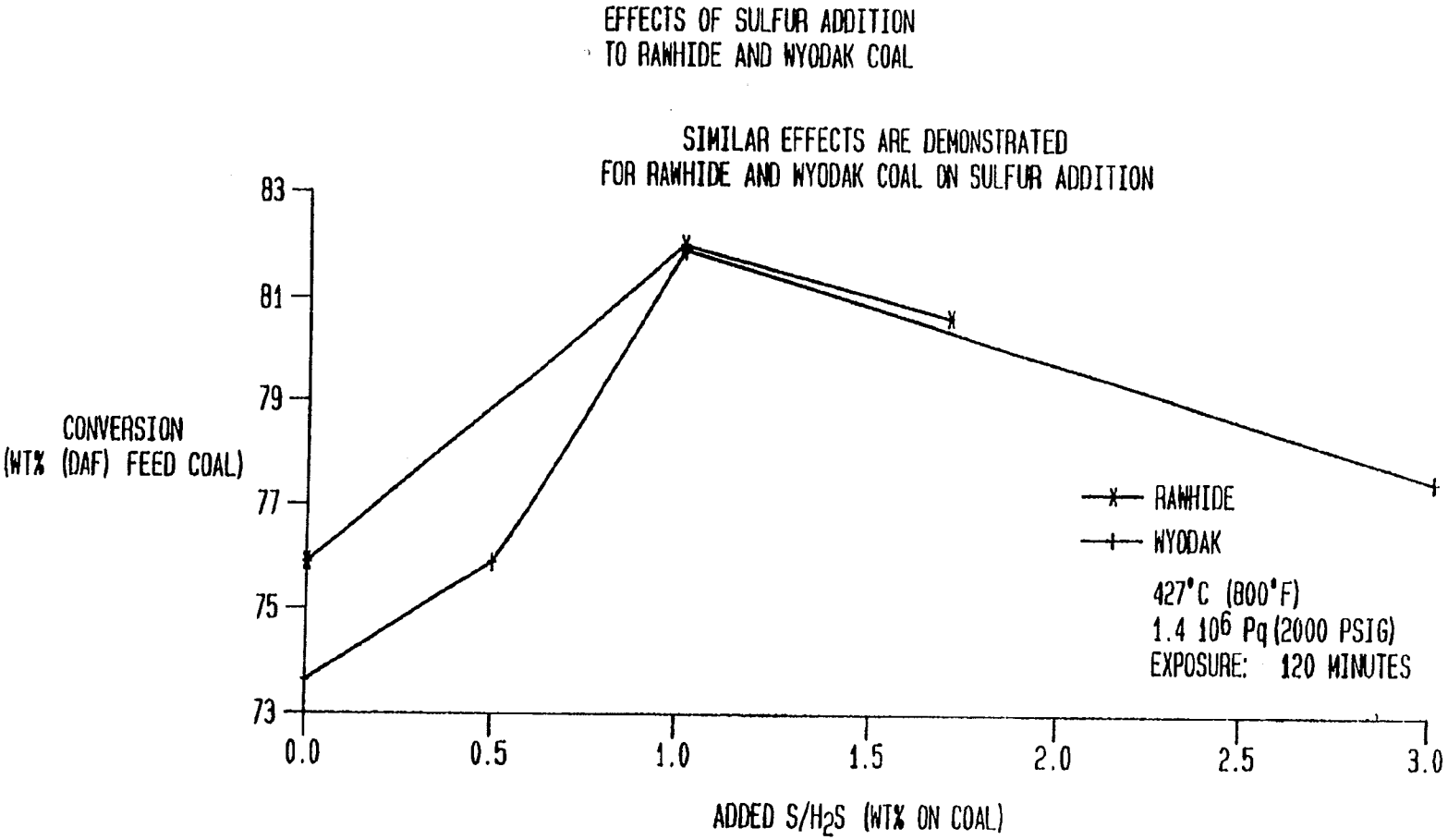
FIG. 1 demonstrates the relationship between the level of conversion (liquefaction) of low sulfur coal and the wt. % of added sulfur or $H_2S$.

The present invention relates to an improved process for liquefying coal and similar solid carbonaceous materials wherein total carbon conversion in the coal or solid carbonaceous material is increased by effecting the liquefaction of at least a portion of the solid carbonaceous feed in the presence of a catalyst, a sulfiding agent, a solvent, and a source of hydrogen.

The applicants have found that the addition of a separate sulfur containing component such as elemental sulfur or $H_2S$ is important in order to achieve optimum liquefaction performance, if low sulfur western coals such as those from the Wyodak and Rawhide mines are employed in a liquefaction process. Low sulfur coals generally contain from 0 to about 0.5 wt. % sulfur.

Surprisingly, it has been found by the applicants that addition of a separate sulfur containing component to coals with a sulfur content above 0.5 wt. %, such as Monterey coal, also improves conversion. Carbon conversion and coal liquefaction are increased and gas production is decreased if a sulfur promoter is added in an effective range to the coal during the liquefaction process.

The instant invention is an improved catalytic liquefaction process for coals which involves cofeeding a sulfiding agent in at least one stage together with a slurry of fresh coal, solvent and a partially liquefied solid carbonaceous material which is referred to herein as "recycle bottoms" or "bottoms recycle." The bottoms material is primarily recycled from the first separating zone, and may contain VGO or other solvents.

The bottoms material may be introduced from an outside source, however. The liquefaction may be accomplished in a single stage or in a plurality of stages and the catalyst will be present in all stages. The bottoms material may be introduced in all stages or in fewer stages.

The Liquefaction zone is maintained at a temperature within the range from about 343° C. (650° F.) to about 510° C. (950° F.) and at a pressure within the range from about $2.07\times10^6$ to about $2.07\times10^7$ Pa (300 to about 3000 psig). This pressure includes hydrogen partial pressures as well as pressure from light gases such as propane, $H_2S$, and $CO_2$ and light liquids such as recycle solvent, naphtha, and distillates. Sulfur may be added to the Mixing Zone 12 via line 17. The total nominal residence time (NRT) of all the stages will, generally, range from about 25 to about 250 minutes. The essence of the present invention resides in the discovery that for any given solid carbonaceous material and particularly for any given coal, the total conversion of carbon in the solid carbonaceous material to a liquid or gaseous product is optimized by adjusting the amount of added sulfur or sulfur containing compounds. Liquefaction is accomplished either in a single stage or in a plurality of stages. When multiple liquefaction stages are employed, sulfur is added to a single stage or multiple stages. It is generally preferred to incorporate a major portion of the sulfur before conversion in the first liquefaction stage, however.

In an alternate embodiment employing a plurality of stages, part of the gaseous and lighter boiling liquid hydrocarbons may be separated between each stage. Generally, this separation includes all components having a boiling point from about 177° C. (350° F.) to about 343° C. (650° F.). Moreover, a portion of the remaining slurry may be recycled to the immediate previous stage as bottoms recycle. Further, at least a portion of the remaining product slurry may be further separated to yield a solvent or diluent fraction having an initial boiling point within the range from about 177° C. (350° F.) to about 218° C. (425° F.) and a final boiling point within the range from about 288° C. (550° F.) to about 371° C. (700° F.). All or a portion of this fraction may then be hydrogenated to produce a hydrogen-donor solvent which may be used in any one or all of the multiple liquefaction zones.

If liquefaction is accomplished in a plurality of stages, a series of two or more Liquefaction Zones may be arranged in series and operated so that the temperature in each zone increases from the initial to the final zone. It is possible to introduce any of the materials shown entering the Mixing Zone (12) or Liquefaction Zone (22) (see FIG. 2, discussed below) at any of these stages. The effluent from each Liquefaction Zone is then passed to the next succeeding higher temperature zone in the series. Liquid hydrocarbonaceous products are recovered from the effluent withdrawn from the last zone. At each stage, the liquefaction effluent may be separated into a vaporous stream and a liquid stream, the liquid stream consisting of a low molecular weight liquid fraction and a high molecular weight liquid fraction. A sufficient amount of the low molecular weight liquid fraction is removed from the high molecular weight liquid fraction (comprising all mineral matter and all liquids boiling at or above 650° F. including unconverted coal constituents) to form a heavy bottoms stream containing less than about 50 wt. % of the low molecular weight liquid fraction based on the weight of the high molecular weight liquid fraction. The heavy bottoms stream may be treated with additional vacuum gas oil (VGO) and hydrogen-containing gas in a second liquefaction zone. The product of the second liquefaction zone is separated into a vaporous fraction and a liquid fraction. Hydrogenated liquid products are recovered from the vaporous and liquid fractions. The high molecular weight constituents in the liquid fraction from the second liquefaction reactor may be further treated with recycled vacuum gas oil and hydrogen-containing gas in a third liquefaction zone.

As previously indicated, catalyst will be present in all stages and may be added as necessary to the slurry containing the solid carbonaceous material, sulfiding agent, and recycled bottoms. The catalyst may be added in any stage in the form of catalyst or catalyst precursor. As previously indicated, the sulfiding agent may also be added at any stage, although it is generally preferred to incorporate a major portion of the sulfur before conversion in the first liquefaction stage.

In general, solid carbonaceous materials which are known to be susceptible to hydrogenation, cracking and liquefaction may be used in the instant invention. The method of the present invention is particularly useful in the liquefaction of coal, coke, wood and similar solid carbonaceous materials containing a relatively high ratio of carbon to hydrogen. In general, coals known in the prior art including anthracite, bituminous coal, subbituminous coal, lignite, and mixtures thereof may be liquefied with the method of this invention.

The solid carbonaceous material will be ground to a finely divided state. The particular particle size or particle size range actually employed, however, is not critical to the invention, and essentially any particle size can be employed. Notwithstanding this, generally, the solid carbonaceous material which is liquefied in accordance with this invention will be ground to a particle size of less than $\frac{1}{4}$ inch and preferably to a particle size of less than about 8 mesh (NBS sieve size).

Solvents useful in this invention include any of the solvents or diluents known in the prior art to be useful in the liquefaction of coal and similar solid carbonaceous materials. When a solvent having donatable hydrogen is to be used, any of the solvents or diluents known in the prior art to contain donatable hydrogen can be used in the improved process of this invention. Suitable hydrogen-donor solvents containing at least 1.00 wt. % donatable hydrogen include pure compounds as well as mixtures of such compounds in combination with components which will not donate hydrogen at liquefaction conditions. Compounds which will donate hydrogen during liquefaction are believed well known in the prior art and many are described in U.S. Pat. No. 3,867,275. These include the dihydronaphthalenes, the $C_{10}$–$C_{12}$ tetrahydronaphthalenes, the hexahydrofluorenes, the dihydro-, tetrahydro-, hexahydro- and octahydrophenanthrenes, the $C_{12}$–$C_{13}$ acenaphthenes, the tetrahydro-, hexahydro- and decahydropyrenes, the di-, tetra- and octahydroanthracenes, and other derivatives of partially saturated aromatic compounds. The donor hydrogen solvent can be prepared by subjecting a distillate stream from atmospheric distillation to a conventional hydrogenation reactor. Particularly effective mixed solvents include heavy gas oil fractions (often called vacuum gas oils, or VGO) with an initial boiling point of about 343° C. (650° F.) and a final boiling point of about 538° C. (1000° F.). This stream comprises aromatics, hydrogenated aromatics, naphthenic hydrocarbons, phenolic materials, and similar compounds. If a solvent is used which does not have donatable hydrogen, hydrogen may be added from another source.

Catalysts known to exhibit hydrogenation activity for the liquefaction of coal may be used in the improved liquefaction process of this invention. Such catalysts include the metals of Group IIB, IVB, VB, VIB, VIIB and VIII of the Periodic Table of the Elements. Generally, the catalyst or a precursor thereof will be added to the slurry entering the mixing zone in a form which is readily dispersible or soluble in the solvent or diluent used during liquefaction. Suitable compounds (precursors) convertible to active catalysts under process conditions include (1) inorganic metal compounds such as halides, oxyhalides, hydrated oxides, heteropoly acids (e.g., phosphomolybdic acid, molybdosilisic acid); (2) metal salts of organic acids such as acyclic and alicyclic aliphatic carboxylic acids containing two or more carbon atoms (e.g., toluic acid); sulfonic acids (e.g., toluene-sulfonic acid); sulfinic acids; mercaptans, xanthic acid; phenols, di- and polyhydroxy aromatic compounds; (3) organometallic compounds such as metal chelates, e.g., with 1,3-diketones, ethylene diamine, ethylene diamine tetraacetic acid, phthalocyanines, etc.; (4) metal salts of organic amines such as aliphatic amines, aromatic amines, and quaternary ammonium compounds.

As indicated previously, the metal constituent of the metal catalyst compound or precursor is selected from the group consisting of Groups IIB, IVB, VB, VIB, VIIB and VIII of the Periodic Table of the Elements, and mixtures thereof, in accordance with the table published by E. H. Sargent and Company, copyright 1962, Dyna Slide Company, that is, zinc, cadmium, mercury, tin, lead, vanadium, niobium, tantalum, chromium, molybdenum, tungsten, manganese, rhenium, iron, cobalt, nickel. The preferred catalyst compounds or precursors are the oil soluble metal compounds containing a metal selected from the group consisting of molybdenum, vanadium and chromium. More preferably, the metal constituent is selected from the group consisting of molybdenum and chromium. Most preferably, the metal constituent of an oil soluble metal compound is molybdenum. Preferred compounds of the metal include the salts of acyclic (straight or branched chain) aliphatic carboxylic acids, salts of alicyclic aliphatic carboxylic acids, heteropolyacids, hydrated oxides, carbonyls, phenolares and organo amine salts. Another preferred metal compound is a salt of an alicyclic aliphatic carboxylic acid such as the metal naphthenate. The most preferred types of metal compounds are the heteropoly acid, e.g., phosphomolybdic acid as well as oil soluble and/or highly dispersible molybdenum complexes selected from:

$$MoO_2(S_2CNR_2)_2$$

where R is a $C_1$ to $C_{18}$ alkyl group, a $C_5$ to $C_8$ cycloalkyl group, a $C_6$ to $C_{18}$ alkyl substituted cycloalkyl group, or a $C_6$ to $C_{18}$ aromatic or alkyl substituted aromatic group; or $$Mo_2O_2(\mu-S)_2(S_2CNR_2)_2$$

where R is as indicated, or any related complex of molybdenum with dithiocarbamate, dithiophosphate, xanthates, or thioxanthate ligands.

The catalyst or catalyst precursor will be added to the slurry at a concentration within the range from about 20 to about 2000 ppm, based on active metal, by weight of dry coal feed, such that the catalyst concentration in the liquefaction vessel will be within the range from about 30 to about 6000 ppm based on total solids depending upon the amount of bottoms recycled during the liquefaction operation. When multiple stages are employed the catalyst concentration in any particular stage may vary due to different amounts of bottoms recycled to different stages but the catalyst concentration within any given stage or zone will be within the aforementioned range of from about 30 to about 6000 ppm, based on active metal components, by weight of total solids.

The sulfiding agent is conveniently introduced in readily releasable forms, non-limiting examples including $H_2S$, elemental sulfur, or sulfur containing hydrocarbons. Use of elemental sulfur is generally preferred for low toxicity, low cost and ease of handling. Elemental sulfur, either as the sublimed powder or as a concentrated dispersion of sublimed powder, such as commercial flowers of sulfur, in heavy hydrocarbonaceous oil, is introduced into the Mixing Zone. Allotropic forms of elemental sulfur, such as orthorhombic and monoclinic sulfur are also suitable for use herein. The preferred physical form of sulfur is the sublimed powder (flowers of sulfur), although sulfur may also be introduced as molten sulfur and as sulfur vapor. The amount of sulfur added into the Mixing Zone is such that the atomic ratio of sulfur to metal is from about 1/1 to 8/1, preferably from about 2/1 to 7/1 and more preferably from about 3/1 to 6/1. Alternatively, sulfur can be added at any point in the catalyst concentrate preparation procedure as long as it is not contacted with an aqueous solution prior to it being introduced into oil. For example, it can be added as a concentrate in a hydrocarbonaceous oil after the precursor concentrate has been dried. It can also be introduced into the Liquefaction Zone during formation of the catalyst concentrate. If the elemental sulfur is added as a concentrate in oil, the amount of sulfur in the concentrate is such that it still meets the aforementioned requirements pertaining to atomic ratio of sulfur to metal. That is, the atomic ratio of sulfur to metal of the metal compound will remain 1/1 to 8/1.

$H_2S$ can be recycled to the Liquefaction Zone from the first Separation Zone. The process of this invention can be advantageously applied using both presulfided and non-presulfided catalysts and catalyst precursors with or without continuous bottoms recycle. The preferred ranges of feed sulfur addition correspond to catalytic liquefaction operations with about 100 ppm fresh catalyst or catalyst precursor and about 400–700 ppm catalyst contained in bottoms recycle, based on the weight of dry coal. The sulfur concentration in the different coal varieties is, in general, constant. Therefore the amount of sulfur added to the coal remains constant. The range of concentration of sulfiding agent is from about 0.1 to 5.0 wt. %, preferably from about 0.2 to 4.0 wt. %, most preferably from about 0.5 to 1.5 wt. % sulfur, based on moisture free coal. FIG. 1 demonstrates that sulfur addition, by the use of elemental sulfur or $H_2S$, enhances conversion optimally over this range. Continued addition of sulfur diminishes conversion. While the exact origin of the "volcano" type sulfur dependence illustrated in FIG. 1 is not well established, it appears that low levels of feed sulfur promote formation and stabilization of $MoS_2$ during the liquefaction reaction. Sulfur also promotes liquefaction by facilitating hydrogen transfer.

Figure 2:
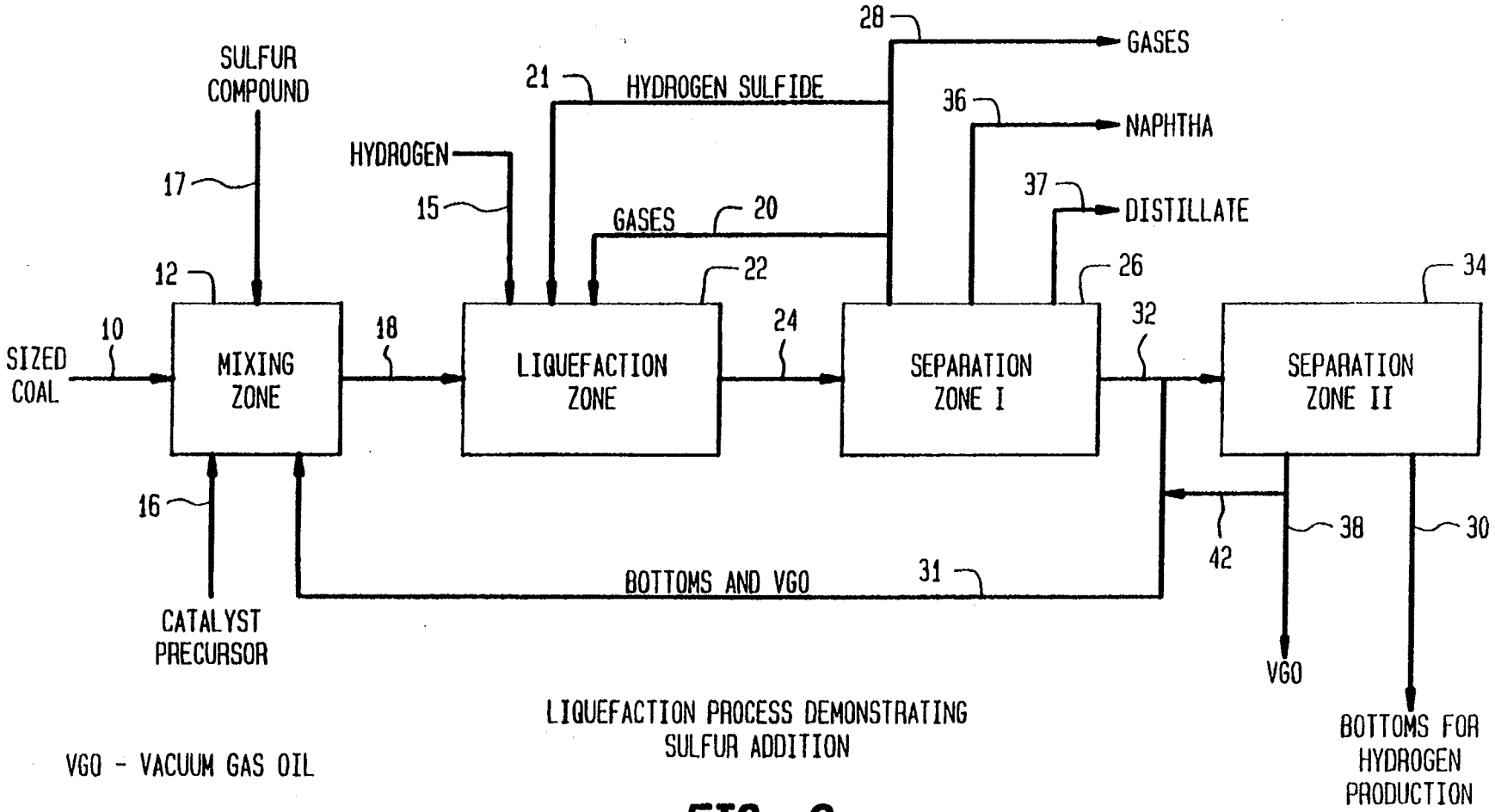
FIG. 2 is a schematic flow diagram of a process within the scope of the present invention. The elements of the process are referenced numerically in the Detailed Description of the Invention.

FIG. 2 illustrates a coal liquefaction process employing sulfur addition. It is described in detail below.

Sized solid carbonaceous material (line 10 in FIG. 2), is slurried with a solvent (such as vacuum gas oil) and bottoms (line 31) and combined with a suitable catalyst (line 16) in Mixing Zone 12. Normally, the ratio of solvent to coal (on a moisture-free basis) in the slurry is within the range from about 0.8:1 to about 4:1 on a weight basis. Ratios in the higher portion of this range are required at higher bottoms recycle rates to ensure that the slurry can be transported by pumping or similar means. Part of the solvent may be recycled from the Separation Zone II through line 42. It is desirable that only sufficient VGO necessary to maintain a pumpable viscosity be recycled.

After the solid carbonaceous material has been slurried, the slurry containing the dispersed or dissolved catalyst or catalyst precursor, sulfiding agent, recycled bottoms, and the solid carbonaceous material is subjected to liquefaction after being moved to Liquefaction Zone 22 via line 18. The Liquefaction Zone effluent is removed from the zone by line 24.

In general, the liquefaction (in Liquefaction Zone 22) results in the production of a gaseous product, a liquid product and a normally solid bottoms product. After liquefaction these products are separated (in Separation Zone I 26 and in Separation Zone II 34) into their respective phases using conventional techniques. Distillation at atmospheric pressure is usually applied in Separation Zone I, and in Separation Zone II, vacuum distillation is applied. The light gases, naphtha and distillate are separated from VGO and bottoms in Separation Zone I. Part of the VGO and bottoms are recycled to the Mixing Zone via line 31. A purge stream from Separation Zone I (line 32) is further separated in Separation Zone II to give VGO (line 38) and bottoms (line 30). The catalyst, in some form, is contained in the heavier product from Separation Zone I.

When a single stage liquefaction system is used, the gaseous and lighter boiling liquid hydrocarbons are flashed overhead in Separation Zone 26. A portion of the remaining slurry is recycled to the Mixing Zone (12) and the rest is further fractionated in a second separator (Separation Zone II, 34). A stream having an initial boiling point within the range from about 177° C. (350° F.) to about 218° C. (425° F.) and a final boiling point within the range from about 371° C. (700° F.) to about 427° C. (800° F.) is Separated from the light hydrocarbons of lines 36 and 37. In an optional embodiment, at least a portion of this stream is subjected to hydrogenation and recycled to the Mixing Zone (12) to act as a hydrogen donor solvent. In Separation Zone II, the heavier products are separated into two streams. A stream having an initial boiling point within the range from about 288° C. (550° F.) to about 371° C. (700° F.) and a final boiling point within the range from 510° C. (950° F.) to about 593° C. (1100° F.) is withdrawn as a VGO product (line 38) from Separation Zone II and a portion is recycled via line 42. A second stream (line 30) having an initial boiling point within the range from about 510° C. (950° F.) to about 593° C. (1100° F.) is also withdrawn from Separation Zone II. This stream is used to produce hydrogen using a molten partial oxidation process or other conventional processes. It may be discarded if desired. Alternatively, the gaseous and lower boiling liquid hydrocarbon products may be flashed overhead in Separation Zone I and the entire remainder of the slurry subjected to further separation to obtain at least the three fractions, gases, naphtha and distillate, noted above. In this embodiment, at least a portion of the remainder of the slurry is recycled to the Mixing Zone (12).

When a portion of the slurry from Separation Zone I is recycled to the Mixing Zone (12), the load on Separation Zone II is reduced. As a result, the recycling of a portion of the entire slurry after the gaseous and lighter boiling liquid products are flashed overhead is preferred. When this is done, the recycled stream (line 31) has an initial boiling point within the range from about 288° C. (550° F.) to about 427° C. (800° F.) and contains a portion of the unreacted solid carbonaceous material, a portion of the inert material contained in the solid carbonaceous material and a portion of the catalysts initially introduced.

After the liquefaction is completed the gaseous product from the Liquefaction Zone or Zones may be upgraded to a pipeline gas or may be burned to provide energy for the liquefaction process. Alternatively, all or any portion of the gaseous product may be reformed to provide hydrogen for the liquefaction process through line 15. The $H_2S$ gas may be separated and recycled to the Liquefaction Zone 22 by line 21.

The liquid products may be fractionated into essentially any desired product distribution. A portion thereof may also be used directly as a fuel or upgraded using conventional techniques. Generally, a naphtha boiling range fraction will be recovered and the naphtha fraction will be further processed to yield a high-quality gasoline or similar fuel boiling in the naphtha range.

The following non-limiting examples are presented to illustrate the invention.

EXAMPLE 1

In this example, a series of experimental runs was completed with an Illinois #6 coal (Monterey mine) in a bench stirred autoclave unit with a volume of 380 cc. In each run, the particle size of the coal was −100 mesh. In each of the series of runs, a slurry was prepared containing 39 wt. % coal and 1000 ppm of metal as molybdenum based on the weight of dry coal. The molybdenum was in the form of molybdenum dioxodithiocarbamate. Three sets of liquefaction conditions were carried out: 427° C. (800° F.)/150 minutes, 450° C. (840° F.)/60 minutes, and 427° C. (800° F.)/120 minutes. In each set of runs, 1 wt. % on a moisture-free basis of sulfur was added in one run, and no sulfur was added in the other run. The sulfur was added in the form of carbon disulfide. All the reactions were carried out at $1.6\times10^7$ Pa (2300 psig) constant pressure and were agitated at 1500 rpm to promote the hydrogen transfer from the gas phase to the liquid phase. Molecular hydrogen was initially added to the liquefaction reactor in an amount of 7 wt. % based on dry coal The hydrogen was continuously added to the autoclave as it was consumed, the total hydrogen added being 9 wt. % based on dry coal. In each run a solvent having an initial boiling point of 343° C. (650° F.) and a final boiling point of 538° C. (1000° F.), usually a vacuum gas oil stream, was used. The Monterey coal has the following analysis:. Ash 9.67%, C 69.62%, H 4.81%, S 4.38%, N 1.30%, and 0 10.224%. The (H/C) atomic ratio is 0.84. The coal conversion and $C_1$–$C_4$ gas yield for each run is summarized in Table I.

TABLE I

LIQUEFACTION PERFORMANCE WITH ADDED SULFUR AND MONTEREY COAL

| | | | | | | |
|---|---|---|---|---|---|---|
| Temperature, °C. | 427 | 427 | 450 | 450 | 427 | 427 |
| Temperature, °F. | 800 | 800 | 840 | 840 | 800 | 800 |
| Residence Time, minutes | 150 | 150 | 60 | 60 | 120 | 120 |
| Sulfur Added, wt. % on Coal | 1.0 | 0.0 | 1.0 | 0.0 | 1.0 | 0.0 |
| Yields, wt. % DAF* coal | | | | | | |
| $C_1$–$C_4$, gas | 8.3 | 8.7 | 9.0 | 11.2 | 6.4 | 6.7 |
| $C_5$–538° C. (1000° F.) liquids | 55.0 | 51.6 | 53.8 | 48.3 | 53.0 | 49.1 |
| Conversion % | 71.2 | 67.9 | 70.3 | 66.9 | 66.8 | 63.5 |
| δ Conversion | 3.3 | base | 3.4 | base | 3.3 | base |

*DAF = dry-ash-free

The Monterey coal with sulfur added showed an increase in conversion of over 3 wt. % under three sets of conditions when compared with the coal without sulfur added. It is clearly shown from the table that sulfur addition increased conversion and reduced the undesirable $C_1$–$C_4$ gas yield.

EXAMPLE 2

Three series of liquefaction studies were conducted in a pilot plant providing capabilities for continuous recycle of a 343° C. (650° F.)/538° C. (1000° F.) coal liquid solvent and 538° C.+ (1000° F.+) bottoms. The first series of studies was carried out using a western U.S. coal from the Wyodak mine in the Wyoming Powder River basin. The second and third series of studies were carried out using a Wyoming coal of similar petrographic composition from the Rawhide mine.

The pilot plant used in these investigations employed a nominal coal feed rate of 75 lb/day. An essentially constant reaction temperature of 427° C. (800° F.) or 450° C. (840° F.) was achieved using a series of tubular 1" reactors loaded in a sandbath. The pilot plant was equipped with mix tanks for thoroughly mixing solvent, coal, bottoms, catalyst precursor, and elemental sulfur before injection into the liquefaction reactors. To facilitate this injection, the mix tank and all associated transfer lines were heated to 107°–149° C. (225°–300° F.). In each series of studies, the nominal feed slurry contained about 34 wt. % solvent, 33 wt. % coal mixed with 100 ppm Mo catalyst precursor in the form of phosphomolybdic acid, and 33 wt. % bottoms.

The first series of liquefaction studies was carried out at $1.4\times10^7$ Pa (2000 psig) and 427° C. (800° F.) with a nominal residence time (NRT) of 140 minutes. Hydrogen was added at a treat rate of 10 wt. % on fresh coal. In these studies sulfur was introduced by cofeeding $H_2S$ with hydrogen at rates corresponding to 1.0 or 1.7 wt. % $H_2S$ on coal. The operations were carried out for periods of 200 to 400 hours. Several detailed material balance periods were conducted at each condition after achieving steady state conversion and solvent and bottoms composition. A summary of overall coal conversions and product distributions from these operations is provided in Table II. It can be easily seen that liquefaction performance was substantially improved with 1–2 wt. % added $H_2S$ as compared to the corresponding operation without $H_2S$. It can also be seen that 1 wt. % $H_2S$ was preferred over a higher loading of 1.7 wt. %.

TABLE II

LIQUEFACTION PERFORMANCE WITH ADDED $H_2S$ AND WYODAK COAL

| | | | |
|---|---|---|---|
| Added $H_2S$ (wt. % on coal) | 0 | 1.0 | 1.7 |
| Yields, wt. % DAF coal | | | |
| Conversion | 75.9 | 82.0 | 80.6 |
| $C_1$–$C_4$ Gas | 12.7 | 11.2 | 12.7 |
| $C_5$–538° C. (1000° F.) liquids | 47.8 | 54.8 | 52.5 |
| $CO + CO_2$ | 7.7 | 6.6 | 7.7 |
| $H_2O$ | 12.2 | 14.4 | 11.7 |
| $H_2$ Consumption | 4.8 | 5.2 | 4.8 |

@ 427° C. (800° F.), $1.4\times10^7$ Pa (2000 psig), 140 min NRT

The second series of studies was also carried out at $1.4\times10^7$ Pa (2000 psig), 427° C. (800° F.), 120 minutes nominal residence time (NRT), and with hydrogen treatment rates of 10 to 12 wt. % on fresh coal. However, in these studies, powdered elemental sulfur was used in place of $H_2S$. The sulfur was introduced by adding powdered elemental sulfur into the mix tank together with solvent, coal, bottoms and catalyst precursor. Three levels of added sulfur were investigated: 0.5, 1.0, and 3.0 wt. %. As indicated in Table III and FIG. 2, the effect of added elemental sulfur was similar to that observed with $H_2S$. Liquefaction performance was strongly enhanced with added sulfur, and optimum results were obtained with about 1 wt. % added sulfur on fresh coal.

TABLE III

LIQUEFACTION OF RAWHIDE COAL WITH ADDED ELEMENTAL SULFUR

| | | | | |
|---|---|---|---|---|
| Added Sulfur (wt. % on coal) | 0 | 0.5 | 1.0 | 3.0 |
| Yields, wt. % DAF coal | | | | |
| Conversion | 73.7 | 75.9 | 81.6 | 48.2 |
| $C_1$–$C_4$ Gas | 12.3 | 12.0 | 10.8 | 11.4 |
| $C_5$–538° C. (1000° F.) liquids | 46.6 | 48.9 | 55.3 | 51.3 |
| $CO + CO_2$ | 7.3 | 7.5 | 8.3 | 8.2 |
| $H_2O$ | 11.7 | 11.8 | 11.4 | 11.7 |
| $H_2$-Consumption | 4.9 | 4.9 | 5.0 | 5.1 |

@ 427° C. (800° F.), $1.4\times10^7$ Pa (2000 psig), 120 min NRT

The final series of experiments was carried out at $1.4\times10^7$ Pa (2000 psig), 450° C. (840° F.), 60 minutes residence time, and with hydrogen treatment rates of 8–10 wt. % on coal. In this case, elemental sulfur was again investigated as a liquefaction promoter. As indicated in Table IV, 1.5 wt. % added sulfur had a strong positive effect on performance under these conditions.

TABLE IV

EFFECT OF ADDED SULFUR ON RAWHIDE COAL LIQUEFACTION AT 450° C. (840° F.)

| | | |
|---|---|---|
| Added Sulfur (wt. % on coal) | 0 | 1.5 |
| Yields, wt. % DAF coal | | |
| Conversion | 76.2 | 79.9 |
| $C_1$–$C_4$ Gas | 14.3 | 13.0 |
| $C_5$–538° C. (1000° F.) liquids | 47.2 | 51.3 |
| $CO + CO_2$ | 7.1 | 9.0 |
| $H_2O$ | 12.0 | 10.8 |
| $H_2$ Consumption | 5.2 | 5.0 |

@ 450° C. (840° F.), $1.4\times10^7$ Pa (2000 psig), 60 min NRT

What is claimed:

1. A process for the liquefaction of a solid carbonaceous material, which process comprises:

a. forming a mixture of solid carbonaceous material, a catalyst or a catalyst precursor and an effective amount of a solvent, said catalyst or catalyst precursor being comprised of a thermally decomposable compound of Groups IIB, IVB, VB, VIB, VIIB and VIII of the Periodic Table of the Elements;

b. introducing a sulfiding agent selected from the group consisting of elemental sulfur, hydrogen sulfide, and sulfur containing hydrocarbons into said mixture under conditions sufficient to convert the solid carbonaceous material to a sulfur promoted solid carbonaceous material, wherein the sulfur promoted solid carbonaceous material is comprised of about 0.1–5 wt % active sulfur, on a moisture free basis;

c. introducing said mixture into a Liquefaction Zone wherein at least a portion of said sulfur promoted solid carbonaceous material is converted under liquefaction conditions in the presence of hydrogen to a liquid product.

2. The process of claim 1, wherein said solid carbonaceous material is selected from the group consisting of bituminous coal, sub-bituminous coal, lignite and mixtures thereof.

3. The process of claim 2, wherein said solid carbonaceous material is selected from the group consisting of bituminous and sub-bituminous coal and mixtures thereof.

4. The process of claim 1, wherein said solvent comprises a hydrocarbon material which boils at a temperature above 538° C. (1000° F.).

5. The process of claim 1, wherein the solvent is selected from a petrochemical, coal derived solvent, or a hydrogen donor solvent.

6. The process of claim 5, wherein the solvent is a coal derived solvent having a boiling range from about 343° C. (650° F.) to about 538° C. (1000° F.).

7. The process of claim 1, wherein said catalyst precursor comprises a heteropolyacid.

8. The process of claim 7, wherein said heteropolyacid is phosphomolybdic acid.

9. The process of claim 1, wherein said catalyst precursor comprises a compound selected from the group consisting of dioxo-bis-(n-dibutyldithiocarbamato)-$MoO_2$ and $Mo_2O_2(\mu-S)_2(S_2CNR_2)_2$ where R is n-butyl.

10. The process of claim 1, wherein said liquefaction is accomplished employing a plurality of liquefaction stages.

11. The process of claim 1, wherein the sulfur promoted solid carbonaceous material is comprised of about 0.2–4 total wt % active sulfur, on a moisture free basis.

12. The process of claim 11, wherein the sulfur promoted solid carbonaceous material is comprised of about 0.5–1.5 wt % active sulfur, on a moisture free basis.

* * * * *